US009308970B1

(12) United States Patent
Gefken et al.

(10) Patent No.: US 9,308,970 B1
(45) Date of Patent: Apr. 12, 2016

(54) NET ENGAGEMENT WITH PARACHUTE SLOWDOWN (NEPS) SYSTEM

(71) Applicant: SRI International, Menlo Park, CA (US)

(72) Inventors: Paul Robert Gefken, Mountain View, CA (US); Adam Arnold Edward Ziemba, Menlo Park, CA (US); Jeffrey Williams Simons, Palo Alto, CA (US); Dennis Leigh Holeman, Redwood City, CA (US)

(73) Assignee: SRI International, Menlo Park, CA (US)

( * ) Notice: Subject to any disclaimer, the term of this patent is extended or adjusted under 35 U.S.C. 154(b) by 507 days.

(21) Appl. No.: 13/852,832

(22) Filed: Mar. 28, 2013

Related U.S. Application Data

(60) Provisional application No. 61/635,052, filed on Apr. 18, 2012.

(51) Int. Cl.

| | |
|---|---|
| ***B63B 21/48*** | (2006.01) |
| ***F41H 11/05*** | (2006.01) |
| *B63B 21/00* | (2006.01) |

(52) U.S. Cl.
CPC ..... *B63B 21/48* (2013.01); *F41H 11/05* (2013.01); *B63B 2021/003* (2013.01)

(58) Field of Classification Search
CPC ..... F41H 11/02; F41H 11/05; F41H 13/0006; F41H 11/04; B64D 17/80; B63B 21/48
See application file for complete search history.

(56) References Cited

U.S. PATENT DOCUMENTS

| | | | | | |
|---|---|---|---|---|---|
| 1,151,607 | A * | 8/1915 | Newhall et al. | B63G 9/00 | 114/240 E |
| 2,352,721 | A * | 7/1944 | Krahel | B64D 17/80 | 244/139 |
| 2,536,682 | A * | 1/1951 | Frieder | B63B 21/48 | 114/311 |
| 2,729,409 | A * | 1/1956 | Hand, Sr. | B64D 17/80 | 242/125 |
| RE24,561 | E * | 11/1958 | Hand, Sr. | B64D 17/80 | 244/113 |
| 3,055,621 | A * | 9/1962 | Martin | B64D 17/28 | 244/142 |
| 3,351,010 | A * | 11/1967 | Ainslie | F41H 11/14 | 102/387 |
| 3,998,408 | A * | 12/1976 | Caldwell, Jr. | B64D 1/02 | 244/138 R |
| 4,667,902 | A * | 5/1987 | Zenobi | B64D 25/02 | 244/122 A |
| 4,768,417 | A * | 9/1988 | Wright | B63G 9/04 | 102/406 |
| 4,865,273 | A * | 9/1989 | Jones | B64D 17/56 | 244/149 |
| 4,926,780 | A * | 5/1990 | Wiehagen | B63B 21/48 | 114/293 |

(Continued)

OTHER PUBLICATIONS

L. Chiang, S. Dunker, "Concept of Using Drogue Chutes as a Ship Decelerator System," Waterside Security Conference, Marina di Carrara, Italy, Nov. 2010; 5 pgs.

*Primary Examiner* — Joseph W Sanderson
*Assistant Examiner* — Steven Hawk
(74) *Attorney, Agent, or Firm* — Schmeiser, Olsen & Watts LLP

(57) ABSTRACT

A momentum altering system comprises a transportation device configured to transport the momentum altering system towards an object moving through water. An engagement device is configured to attach to the object when the momentum altering system is transported sufficiently near the object. At least one decelerating device is connected to the engagement device. At least one decelerating device is deployed by the engagement device after the engagement device attached to the object. At least one decelerating device includes a plurality of parachute sea anchors that produce drag when pulled though water thereby altering momentum of the object.

6 Claims, 11 Drawing Sheets

(56) References Cited

U.S. PATENT DOCUMENTS 5,069,109 A * 12/1991 Lavan, Jr. ..... B63G 9/04 114/240 C
5,317,985 A * 6/1994 Shewmon ..... B63B 21/48 114/311
6,031,377 A * 2/2000 Watkins ..... G01V 3/165 324/226
6,325,015 B1 * 12/2001 Garcia ..... B63B 21/56 114/240 C
6,394,016 B2 * 5/2002 Swartout ..... B63B 21/56 114/254
6,591,774 B2 * 7/2003 Metherell ..... F41H 11/05 114/240 E
6,681,709 B1 * 1/2004 Nixon ..... B63G 9/04 114/240 C
6,883,756 B2 * 4/2005 Preston ..... B64D 17/58 244/149
6,889,942 B2 * 5/2005 Preston ..... B64D 1/14 244/152
6,918,350 B1 * 7/2005 Morse ..... B63B 21/48 114/382
6,980,483 B2 * 12/2005 McDonald ..... B63G 9/04 114/240 D
7,401,565 B2 * 7/2008 Nixon ..... F41H 11/05 114/240 C
7,411,863 B2 * 8/2008 Toennessen ..... G01V 1/3808 367/20
7,441,511 B2 * 10/2008 Farinella ..... B63H 25/50 114/382
7,584,928 B2 * 9/2009 Hoffmann ..... B64D 17/74 244/137.3
8,176,867 B2 * 5/2012 Gayton ..... B63G 13/00 114/240 D
8,399,816 B2 * 3/2013 Glasson ..... F41H 11/04 244/1 R
8,714,070 B2 * 5/2014 Martinez ..... F41H 13/0006 114/317
8,776,710 B2 * 7/2014 Gayton ..... B63G 13/00 114/240 D
2002/0047274 A1 * 4/2002 Williams ..... F03B 17/066 290/54
2002/0073908 A1 * 6/2002 Fiorentino ..... B63B 21/48 114/311
2002/0078872 A1 * 6/2002 Callahan ..... B63B 7/082 114/112
2003/0051652 A1 * 3/2003 Metherell ..... F41H 11/05 114/241
2003/0197095 A1 * 10/2003 Preston ..... B64D 1/14 244/152
2004/0194688 A1 * 10/2004 Metherell ..... F41H 11/05 114/382
2005/0016372 A1 * 1/2005 Kilvert ..... F42B 12/66 89/1.34
2006/0048665 A1 * 3/2006 Kilvert ..... B63C 9/08 102/406
2006/0102088 A1 * 5/2006 Wroldsen ..... A01K 61/007 119/223
2006/0162642 A1 * 7/2006 Morse ..... B63B 21/48 114/382
2007/0017432 A1 * 1/2007 Farinella ..... B63H 25/50 114/382
2007/0223306 A1 * 9/2007 Toennessen ..... G01V 1/3808 367/15
2008/0105184 A1 * 5/2008 Nixon ..... F41H 11/05 114/241
2009/0038530 A1 * 2/2009 Truong ..... B63B 21/48 114/382
2009/0084284 A1 * 4/2009 Martinez ..... B63G 9/04 102/504

* cited by examiner

NET ENGAGEMENT WITH PARACHUTE SLOWDOWN (NEPS) SYSTEM

CROSS-REFERENCE TO RELATED APPLICATIONS

This application is a utility application claiming priority to U.S. Provisional Application Ser. No. 61/635,052 filed on Apr. 18, 2012 entitled "NET ENGAGEMENT WITH PARACHUTE SLOWDOWN (NEPS) SYSTEM FOR NON-LETHAL MOBILITY HINDERING OF MARITIME VESSELS," the entirety of which is incorporated by reference herein.

GOVERNMENT RIGHTS IN THE INVENTION

This invention was made with government support under grant number N0014-08-C-0329 awarded by the U.S. Navy, Office of Naval Research (ONR). The government has certain rights in this invention.

FIELD OF THE INVENTION

The invention relates generally to systems for altering the momentum of vessels. More specifically, the invention relates to reducing the momentum of maritime vessels using parachute sea anchors (PSA).

BACKGROUND

Large maritime vessels have considerable momentum while in motion. Stopping these vessels quickly and over a short distance is of particular interest, for example when intercepting hostile vessels engaged in sea piracy. A drogue chute is a canopy shaped device that is used by mariners in a storm to keep the bow of the vessel pointed in the direction of the prevailing waves.

The publication "Concept of Using Drogue Chutes as a Ship Decelerator System" describes the use of a series of equal sized drogue chutes to decelerate a ship but fails to provide a complete solution to remotely intercepting and decelerating a vessel (see Chiang, L., Dunker, S., "Concept of Using Drogue Chutes as a Ship Decelerator System," Waterside Security Conference, Marina di Carrara, Italy, November, 2010). Indeed, this publication describes this well recognized and long standing problem in its conclusion by stating "However, more testing and development would be required when sizing the system to full scale as the system would have a considerable increase in volume and weight, that could make it more difficult to maneuver and position than subscale systems. Attaching the system to oncoming vessel would be another challenging development to address. [sic]"

Deploying a decelerating system is further complicated by the variety of bow shapes, and potential misalignment between the ship trajectory and the deployed system. In addition, there are considerable forces involved in decelerating a ship with a hull displacement up to and exceeding 300,000 tons at 10-20+ knots without resorting to excessively bulky or heavy materials. A system is required that can deploy a lightweight and small form factor device remotely towards a hostile vessel, attach to the vessel and then decelerate the vessel in a short period of time.

BRIEF SUMMARY

In one aspect, the invention features a momentum altering system comprising a transportation device configured to transport the momentum altering system towards an object moving through water. An engagement device is configured to attach to the object when the momentum altering system is transported sufficiently near the object. At least one decelerating device is connected to the engagement device. At least one decelerating device is deployed by the engagement device after the engagement device attached to the object. At least one decelerating device includes a plurality of parachute sea anchors (PSAs) that produce drag when pulled though water thereby altering momentum of the object.

In another aspect, the invention features a momentum altering system comprising a transportation device configured to transport the momentum altering system from an aircraft towards an object moving through water. The transportation device includes a parafoil. An engagement device is configured to attach to the object when the momentum altering system is transported sufficiently near the object. The engagement device comprises a load bearing line in communication with a one or more self-tensioning loops, the one or more self-tensioning loops are in communication with a base net based on a tensegrity structure with a lasso. The self-tensioning loops distort the base net to increase a contact area between the base net and the object upon contact of a portion of the base net with the object. At least one decelerating device is connected to the engagement device. The at least one decelerating device is deployed by the engagement device after the engagement device attaches to the object. Deploying the at least one decelerating device includes deploying a plurality of parachute sea anchors (PSAs) at a preset time by a programmable time release unit (PTRU) that includes a timer. Each of the plurality of PSAs is deployed with temporal separation from another of the plurality of PSAs sufficient to alter the momentum for the object within a load limit of each of the plurality of PSAs. Each of the plurality of PSAs produces drag against a progressively larger volume of water than a previously deployed PSA of the same deceleration device.

In another aspect, the invention features a momentum altering method comprising transporting a net toward an object moving through water. The net has a lasso-based structure connected to a plurality of parachute sea anchors (PSAs) by a plurality of self-tensioning loops. The object is engaged with the net. Each of the plurality of PSAs is deployed into the water with temporal separation from another of the plurality of PSAs. Each of the plurality of PSAs resists a larger volume of water than a previously deployed PSA. The net tightens to substantially conform to a feature of the object by causing at least one of the plurality of self-tensioning loops to move thereby distributing a load of the plurality of PSAs to the net. The object is decelerated by resisting a flow of water.

BRIEF DESCRIPTION OF THE SEVERAL VIEWS OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

FIG. 3B.

DETAILED DESCRIPTION

Embodiments of systems described herein provide for the efficient deployment of a decelerating device, the attachment or engagement of the device to a maritime vessel and the deceleration of the vessel within a short period of time. The decelerating device is launched from a variety of platforms including, but not limited to, aircraft, ships, rapid inflatable boats (RIB), helicopters and drones as further described in the embodiments herein. The launching or deployment of the device, the attachment to the vessel and the timed opening of each of the PSAs operates as an integrated NEPS system allowing for the effective interdiction and deceleration of maritime vessels. In another embodiment the NEPS system is used to decelerate runaway vessels arriving at a port of call. In other embodiments, the NEPS system provides a differential drag on a vessel to alter its trajectory. In another embodiment, the NEPS system alters the trajectory of an iceberg.

Figure 1A:
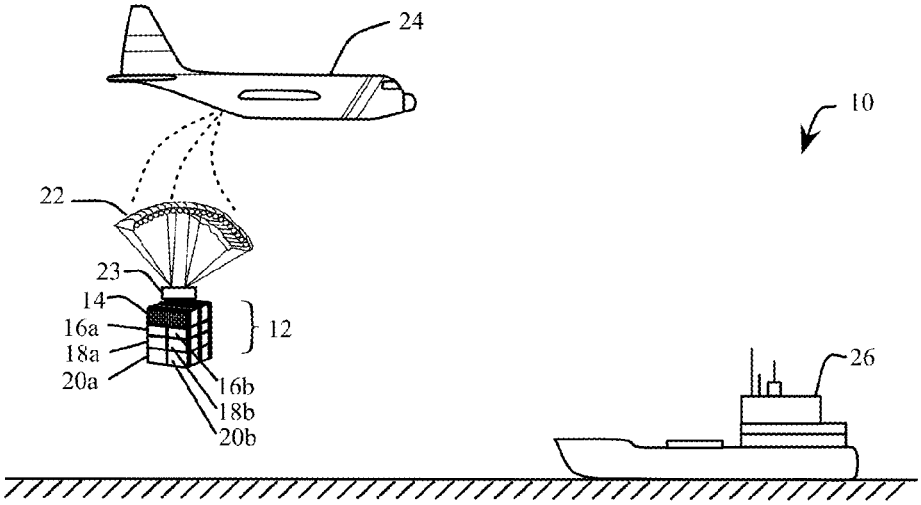
FIG. 1A is an elevation view of a parafoil-guided NEPS system deployed from an aircraft.
Figure 1B:
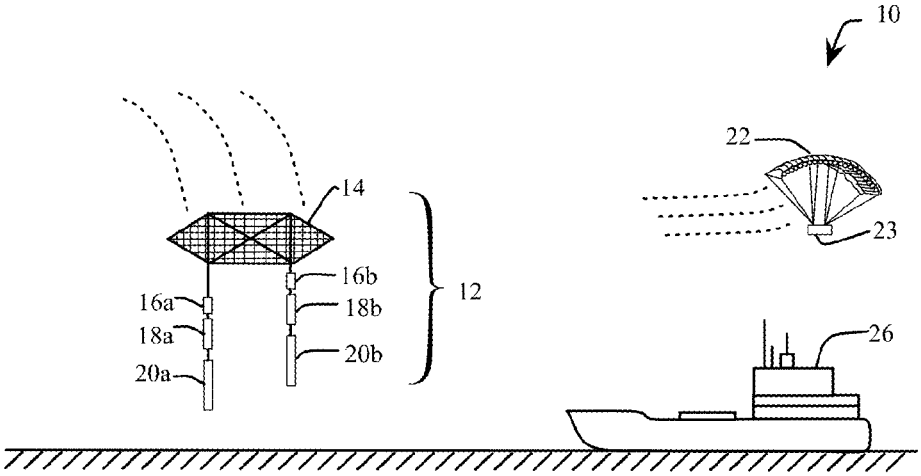
FIG. 1B is an elevation view of the NEPS system in FIG. 1A prior to engaging a vessel.
Figure 1C:
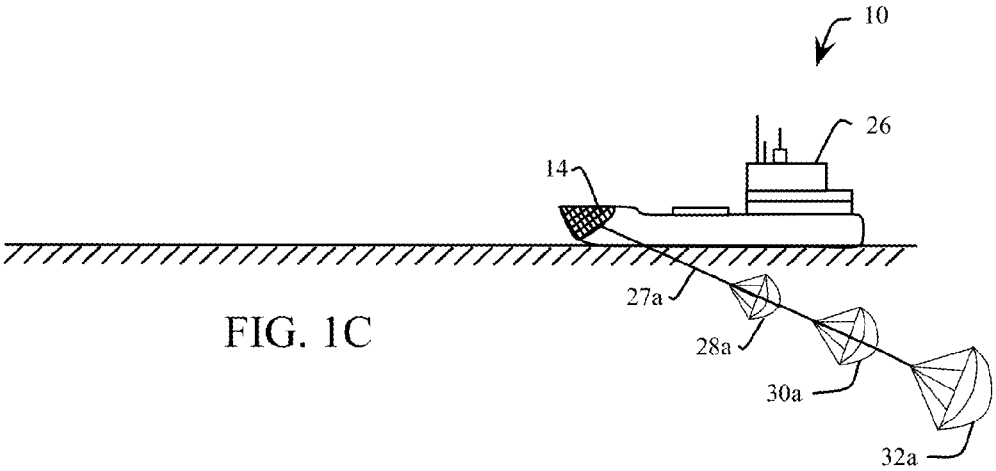
FIG. 1C is an elevation view of the NEPS system in FIG. 1A after engaging the vessel.

FIG. 1A, FIG. 1B and FIG. 1C show an embodiment 10 of a NEPS system 12 deployed from a fixed wing aircraft 24 (e.g. C130). As illustrated in FIG. 1A, the NEPS system 12 includes an engagement net 14, a first pair of small decelerating devices 16*a* and 16*b*, a second pair of medium decelerating devices 18*a* and 18*b*, and a third pair of large decelerating devices 20*a* and 20*b*. Each decelerating device includes a parachute sea anchor (PSA) in a deployment bag. Each PSA is released after a time delay determined by a timer contained in the deployment bag. In other embodiments, the NEPS system 12 includes more than three PSAs on each side for decelerating vessels with more momentum due to higher hull displacement or velocity. In another embodiment, the NEPS system 12 has fewer than three PSAs on each side (e.g two PSAs) and multiple NEPS systems are deployed to stop a larger vessel. The use of multiple NEPS systems with two PSAs allows the rate of vessel deceleration to be modified for each encounter with a vessel. In one example, the use of multiple NEPS systems is used to decelerate vessels with very large hull displacement.

The engagement net 14 and decelerating devices are bundled together and attached to a parafoil (e.g. JPADS 2K) 22 coupled with a controller 23 that releases the parafoil 22 from the NEPS system 12 and provides guidance to steer the parafoil 22 towards the bow of the ship 26. FIG. 1B shows the NEPS system 12 being steered towards the bow of a vessel or ship 26 by the parafoil 22 and the parafoil 22 subsequently detaching from the NEPS system 12. The parafoil 22 then drifts away. Alternatively, the parafoil 22 is maneuvered away from the ship 26 by the controller 23. In one embodiment, the parafoil 22 is steered towards the bow of the ship 26 using a GPS guidance system in the controller 23. In another embodiment, the parafoil 22 is maneuvered with an optical guidance system with pattern recognition capability in the controller 23 to detect the bow of the ship 26. In another embodiment, the parafoil is steered by remote control by a datalink between the aircraft 24 and the controller 23.

When the parafoil 22 guides the NEPS system 12 sufficiently close to the ship 26, the controller 23 detaches the parafoil 22 from the NEPS system 12 and releases the bundled engagement net 14, and deceleration devices on a trajectory towards the bow of the ship 26. The parafoil 22 and controller 23 drift away to be recovered at a later time. In an alternate embodiment, the controller 23 is attached to the NEPS system rather than the parafoil 22.

FIG. 1C shows the NEPS system 12 after the engagement net 14 has captured the bow of the ship 26 and the PSAs have been released from their respective deployment bags. In the embodiment 10 shown in FIG. 1A, FIG. 1B and FIG. 1C, the engagement net 14 is based on a tensegrity structure that expands after it is released as shown in FIG. 1B, while it free-falls onto the bow of the ship 26. For ships with a bulbous bow, the engagement net 14 need only land in the water in front of the ship to engage the bulbous bow directly. Although FIG. 1C shows a hexagonal-shaped engagement net 14 other shapes that support a tensegrity structure are envisioned within the scope of the NEPS system—for example, a pentagon or octogon.

After the engagement net 14 captures the bow of the ship 26, the first PSA 28*a* is released from the decelerating device 16*a* after a time delay. The first PSA 28*a* remains connected to the engagement net 14 with a rode line 27*a*. After a second delay the second PSA 30*a* is released from the decelerating device 18*a* and is connected to the engagement net 14 with the rode line 27*a*. Subsequently, the third PSA 32*a* is released from the decelerating device 20*a* after a third time delay and is also connected to the engagement net 14 with the rode line 27*a*. The staged deployment of the PSAs ensures that the design limits of each PSA are not exceeded. For example, the diameter of PSA 27*a* is less than the diameter of PSA 32*a* thus providing less drag force against the ship 26 while being able to withstand a higher speed through the water. In one embodiment, the ship 26 is decelerated by two groups of PSAs, one on the port (shown in FIG. 1C) and the other on the starboard side (not shown), thereby exerting more drag force on the ship 26 without substantially altering the ships trajectory, increasing the side loading on the engagement net 14 or increasing the risk of the PSAs getting tangled in the ships propellers. In another embodiment, the engagement net 14 connects to a group of PSAs on only one side of the ship 26 to change the ships trajectory.

The deployment of PSAs each with a progressively larger diameter reduces the time required to decelerate the ship 26 without unduly increasing the volume and weight of the NEPS system. This reduction in weight and volume in turn enables the use of a parafoil 22 to transport the NEPS from the aircraft 24 to the ship 26. In other embodiments, a different number or PSAs are used to decelerate ships of different hull displacement and velocity. While the PSAs are shown with round canopies, other shapes are contemplated, for example an elliptical or square canopy. In one embodiment, the PSAs are of different shapes so that each subsequently deployed PSA has a higher drag cooefficient than the previously deployed PSA without necessarily using a circular canopy with a larger diameter.

Figure 2A:
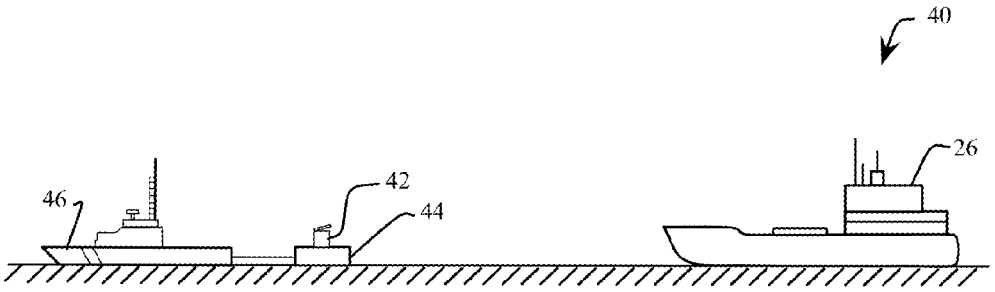
FIG. 2A is elevation view of a rocket-propelled NEPS system deployed from a towable platform.
Figure 2B:
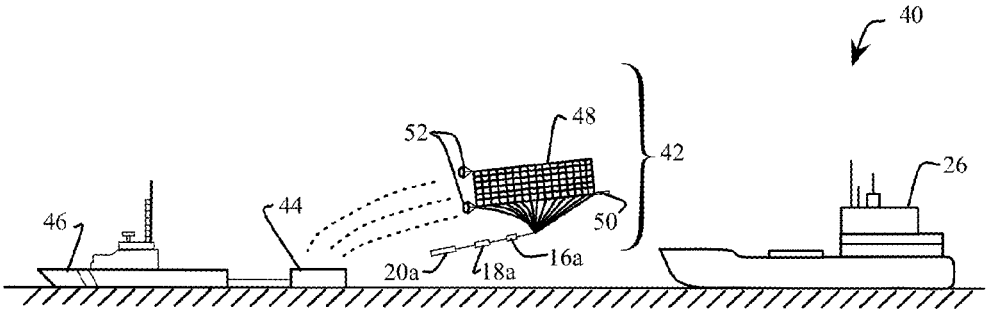
FIG. 2B is an elevation view of the NEPS system in FIG. 2A prior to engaging a vessel.
Figure 2C:
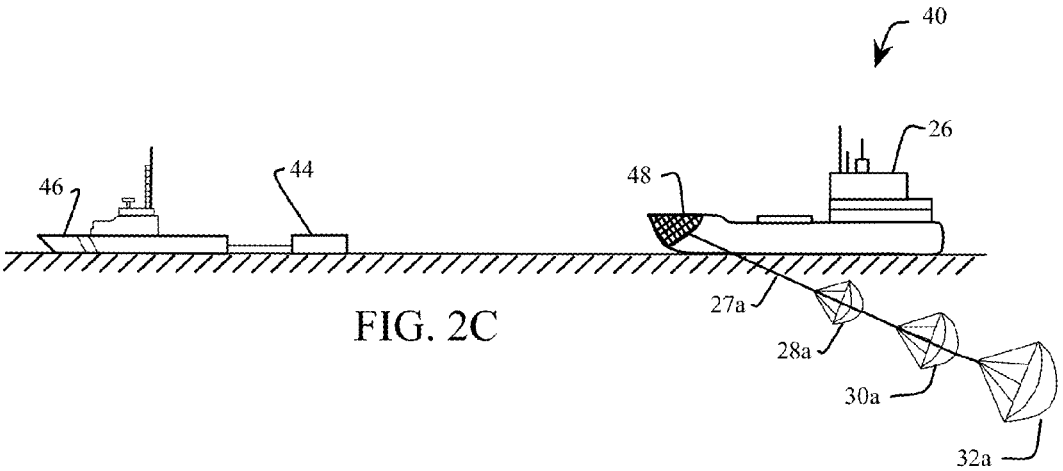
FIG. 2C is an elevation view of the NEPS system in FIG. 2A after engaging the vessel.

FIG. 2A, FIG. 2B and FIG. 2Cs show an embodiment 40 of a NEPS system deployed from another maritime vessel. FIG. 2A shows the NEPS system 42 on a towable platform 44 being towed by a coast guard patrol boat (CPB) 46. In one embodiment, the towable platform 44 is stored remotely from the CPB 46, in a shipping port for example, and quickly attached to the CPB 46 when needed. Alternatively, the towable platform 44 is attached to a rigid inflatable boat (RIB). With reference to FIG. 2B, the NEPS system 42 includes an engagement net 48 that is propelled from the platform 44 towards the ship 26 by one or more rockets 50. The rockets 50 are on the leading edge of the engagement net 48. In one embodiment, drag-chutes 52 are on the trailing edge of the engagement net 48 to keep the engagement net 48 substantially opened prior to capturing the ship 26. Similar to the transegrity-based net 14 shown in FIG. 1A, FIG. 1B and FIG. 1C, the engagement net 48 is attached to decelerating devices 16*a*, 18*a* and 20*a* that will ultimately deploy on one side of the ship 26 and a second chain of decelerating devices 16*b*, 18*b* and 20*b* (not shown) that will deploy on the other side of the ship 26.

FIG. 2C shows the NEPS system 42 after the engagement net 48 has captured the bow of the ship 26 and the PSAs have been released from their respective deployment bags. The engagement net 48 is secured to the bow of the ship 26 with self-tensioning lines that equalize the force of the PSAs 28*a*, 30*a* and 32*a* on the engagement net 48. In a manner similar to that described for FIG. 1C, PSAs 28*a*, 30*a* and 32*a* connect to the engagement net 48 through a rode line 27*a* on the port side of the ship 26. A set of PSAs 28*b*, 30*b* and 32*b* (not shown) also connect to the engagement net 48 through a rode line 27*b* on the starboard side of the ship 26. In other embodiments, a different number of PSAs are used to decelerate ships 26 with different hull displacements and velocities. For example, two PSAs are used for smaller or slower ships in one embodiment and four PSAs are used for larger or faster ships.

Figure 3A:
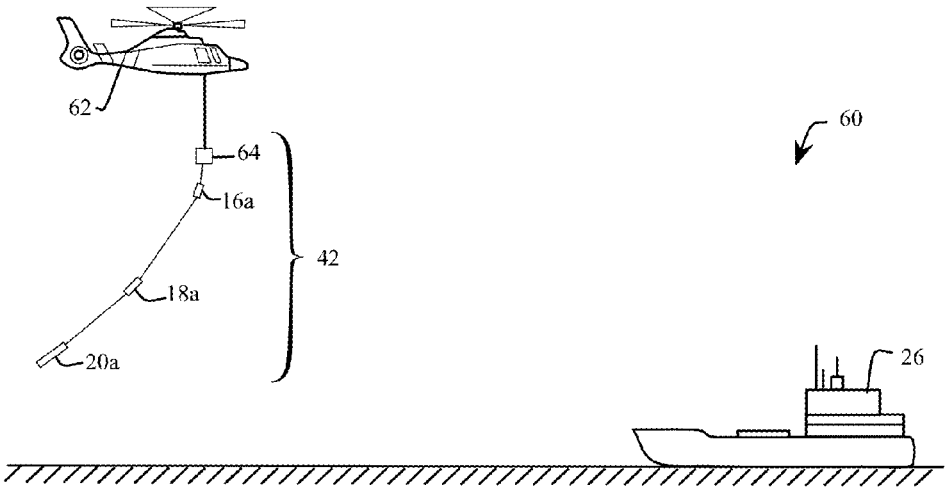
FIG. 3A is an elevation view of a rocket-propelled NEPS system deployed from a helicopter.
Figure 3B:
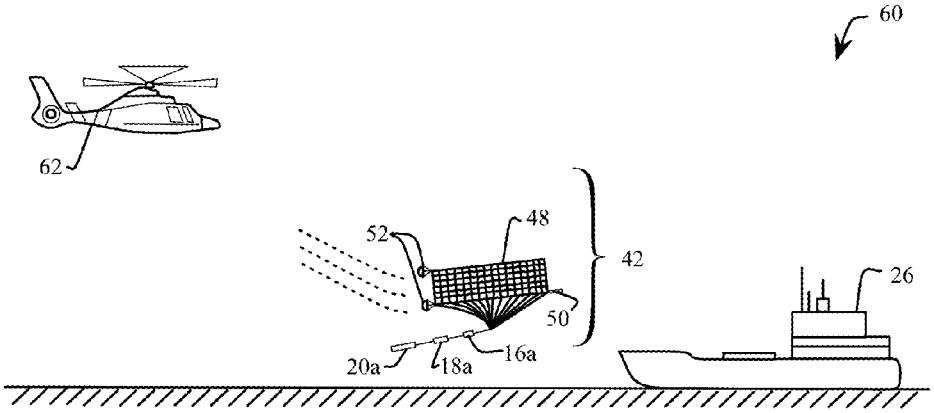
FIG. 3B is an elevation view of the NEPS system in FIG. 3A prior to engaging a vessel.
Figure 3C:
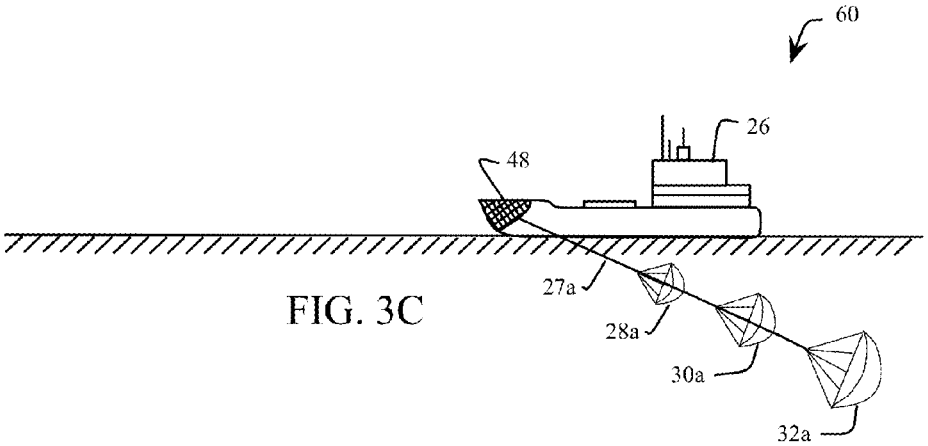
FIG. 3C is an elevation view of the NEPS system in FIG. 3A after engaging the vessel.

FIG. 3A, FIG. 3B and FIG. 3C show an embodiment 60 of a NEPS system 42 deployed from a helicopter 62. With reference to FIG. 3A, the helicopter 62 carries the NEPS system 48 on a detachable line connecting a net container 64 including the engagement net 48, the rockets 50 and the drag-chutes 52. The net container 64 further connects to deceleration devices 16*a*, 18*a* and 20*a* to be deployed on one side of the ship 26 and similar deceleration devices 16*b*, 18*b* and 20*b* (not shown) to be deployed on the other side of the ship.

FIG. 3B shows the NEPS system 42 after being released by the helicopter 62 and the net container 64 being opened to deploy the engagement net 48, the rockets 50 and the drag-chutes 52. In one embodiment, the net container 64 is opened by a datalink with the helicopter 62. The trajectory of the rockets 50 in FIG. 3B differ from the trajectory shown in FIG. 2B because the NEPS system 42 will be deployed from a greater height. In one embodiment, the trajectory of the rockets 50 in FIG. 3B is determined by the weight, balance and aerodynamics of the overall NEPS system 42. In another embodiment, the trajectory of the rockets 50 in FIG. 3B is controlled by a guidance system including in the rockets 50. In another embodiment, the system is deployed by a parafoil, similar to that shown in FIGS. 1A-C, from the helicopter 62.

FIG. 3C shows the NEPS system 42 after the engagement net 48 has captured the bow of the ship 26 and the PSAs have been released from their respective deployment bags in a manner similar to that shown in FIG. 2C. The staged deployment of progressively larger diameter PSAs and the load equalization of the engagement net 48 permits the use of lighter weight materials which enables the use of multiple launching platforms, a few of which have been shown by example in FIG. 1A through FIG. 3C High-strength engagement net systems have been developed that can be used with any of the launching platforms shown in FIG. 1A through FIG. 3C. One embodiment of an engagement net 70 is shown in FIG. 4. The engagement net 70 includes a webbing 72 connected to a plurality of small diameter self-tensioning loops 74*a-p*. Each of the small diameter loops are connected to one of a plurality of medium diameter self-tensioning loops 76*a-f*. Each of medium diameter loops are connected to one of plurality of large diameter self-tensioning loops 78*a-b*. Loop 78*a* is connected to a rode line 82 that connects to a group of PSAs. Loop 78*b* connects to a rode line 80 that connects to another group of PSAs. When the engagement net 70 is used to alter the trajectory of a ship, an iceberg or other maritime objects one of the two rode lines is left unconnected and the webbing 72 will capture an extruding surface—in the case of a vessel the surface is the bow. In one example, when the engagement net 70 is used to attach to an iceberg to alter its trajectory, the engagement net 70 further includes protrusions capable of penetrating the iceberg to secure the engagement net 70 thereto.

Figure 4A:
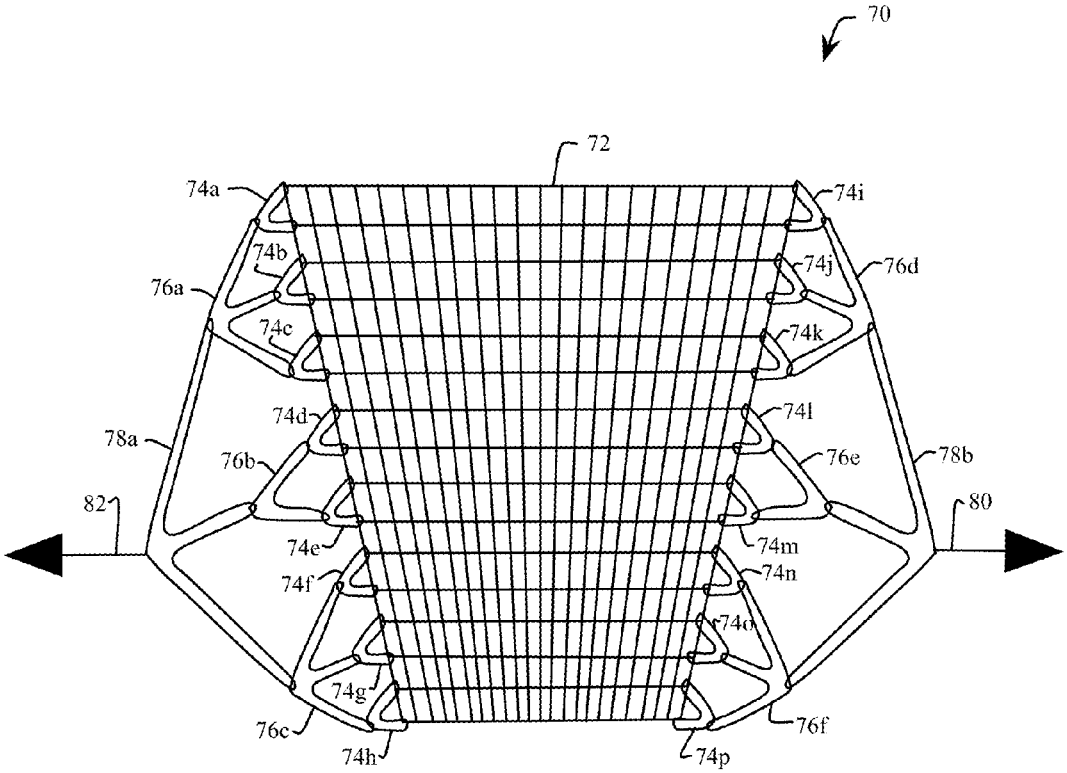
FIG. 4A is a plan view of a self-tensioning engagement net.
Figure 4B:
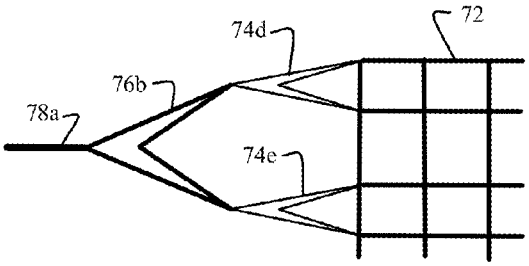
FIG. 4B is schematic view of a portion of the net shown in FIG. 4A before load equalization.
Figure 4C:
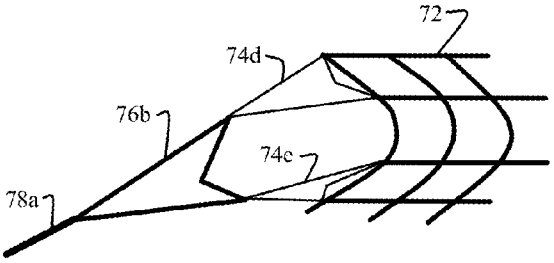
FIG. 4C is a schematic view of the portion of the net shown in FIG. 4B after load equalization.

FIG. 4B and FIG. 4C further illustrate the operation of the self-tensioning loops shown in FIG. 4A. FIG. 4B shows a portion of the net 70 prior to contacting the object whose momentum is to be altered. In one example, the net 70 contacts the bow of a ship as shown in FIG. 1C, FIG. 2C and FIG. 3C. FIG. 4C shows the net 70 distorted to conform to the irregularities and non-planar surface of the bow of the ship. As the net 70 distorts, the self-tensioning loops 74*d* and 74*e* each rotate to equalize the load on webbing 72. Similarly the loop 76*b* rotates to equalize the load on the self-tensioning-loops 74*d* and 74*e*. The self-tensioning loops provide a more even distribution of the load imposed from the PSAs across the net 70, thus permitting the webbing 72 to be made of lighter weight material with lower load bearing capability. The resulting lighter net 70 enables more efficient methods of launching the NEPS system as shown in FIG. 1A through FIG. 3C.

Figure 5:
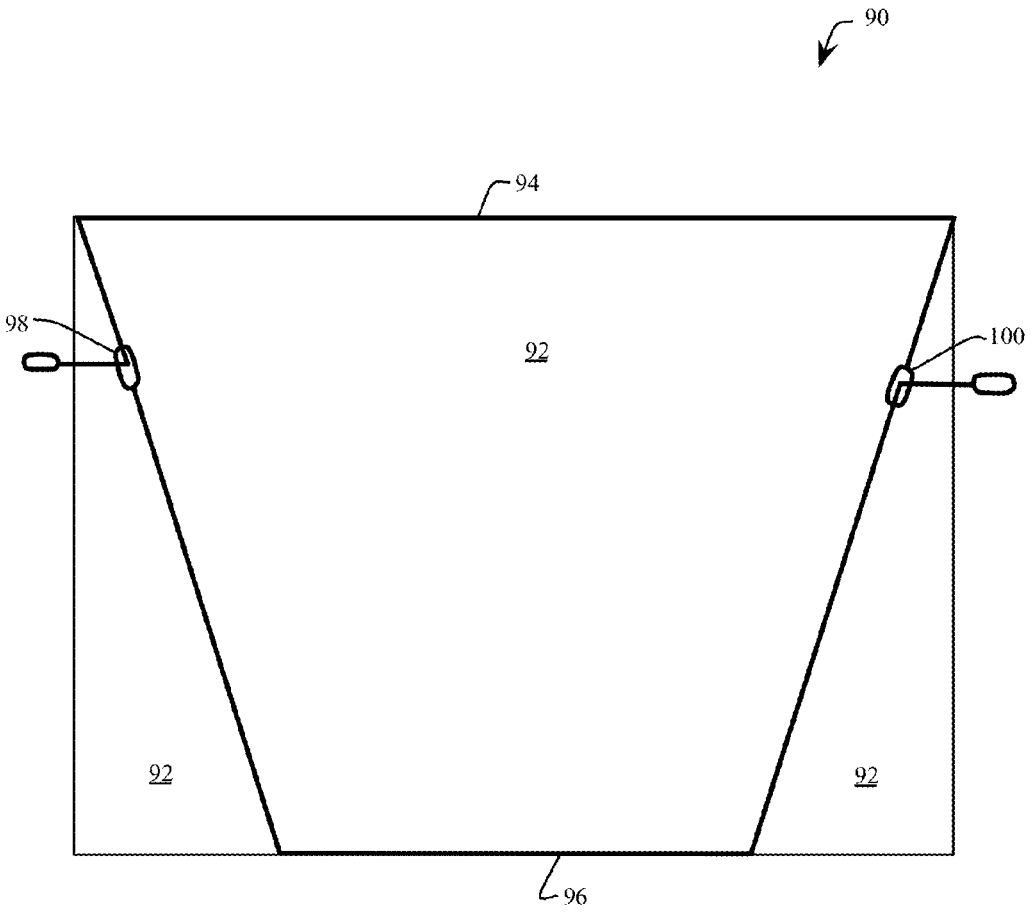
FIG. 5 is a plan view of a lasso engagement net.

FIG. 5 illustrates another embodiment of an engagement net 90 based on a lasso structure. The net 90 includes a base net 92 connected to top load bearing lines 94 and bottom load bearing lines 96. In one example, four lines are used for the top lines 94 paired with four lines for the bottom lines 96. The set of top lines 94 pass through a bottom loop 98 formed by the bottom lines 96 and then connect to a set of self-tensioning loops that form the connection to a rode line. The set of bottom lines 96 pass through a top loop 100 formed by the top lines 94 and then connect to a set of self-tensioning loops that form the connection to another rode line. Specifically, for four load-bearing lines, three total sets of self-tensioning loops are needed, with two sets connecting to the load-bearing lines and one set connecting those two sets to the rode line.

When the base net 92 contacts the bow of a ship or other maritime object and the PSAs are deployed, force on the rode lines will cause the top lines 94 and the bottom lines 96 to pull together and cinch around the bow of the ship, substantially conforming to the shape of the bow to securely attach the PSAs to the ship. The bow would thus be inside what would otherwise be a square knot.

Figure 6:
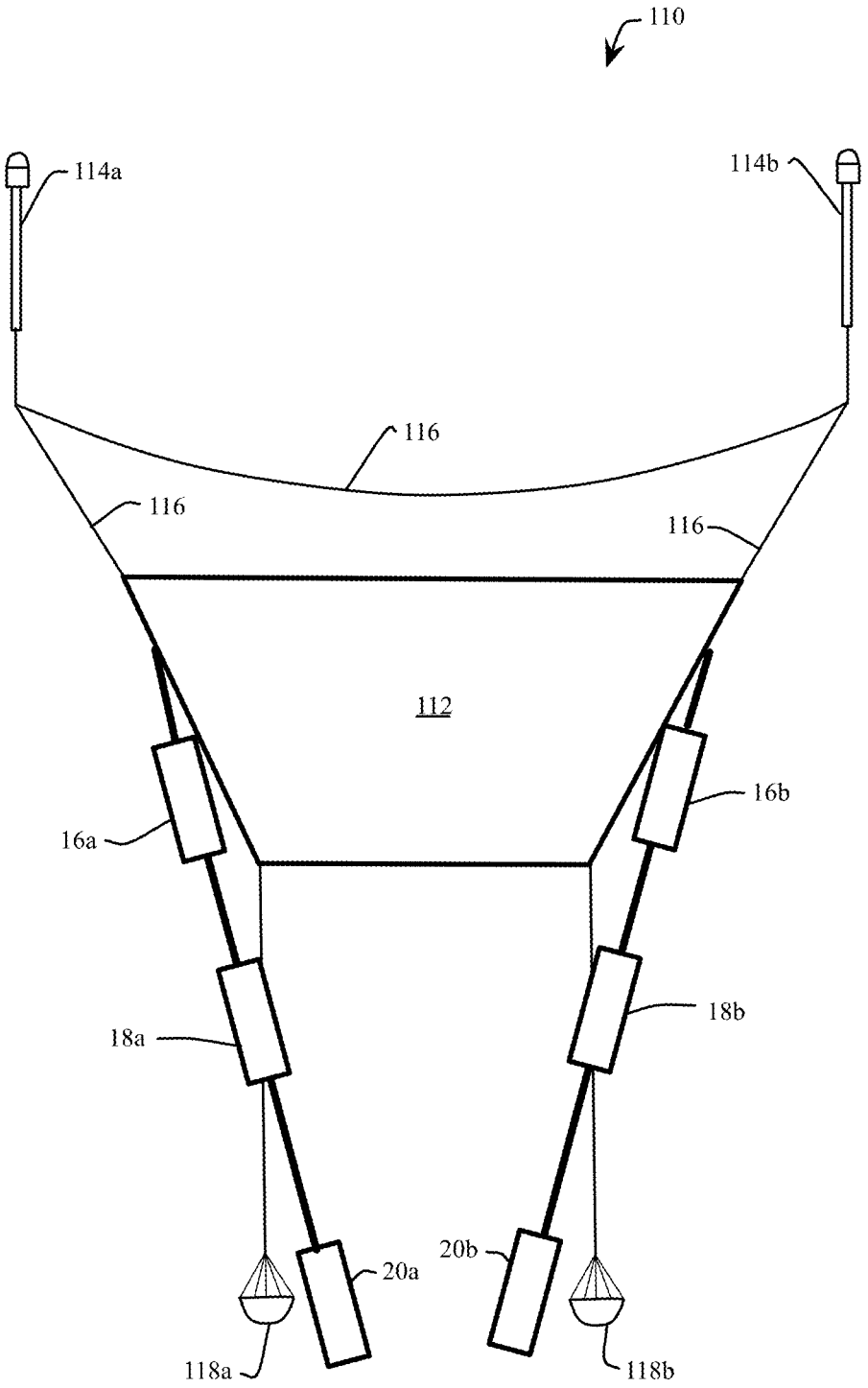
FIG. 6 is a plan view of an embodiment of NEPS system as shown in FIG. 2B.

FIG. 6 illustrates an example of a NEPS system 110 as used in the embodiments shown in FIG. 2B and FIG. 3B. The NEPS system 110 includes a base net 112, which is based on the net structure shown in either FIG. 4A or FIG. 5 in alternative embodiments. The net 112 is propelled towards a maritime object (e.g. a ship) in one example using rocket motors 114*a* and 114*b*. The rockets 114*a* and 114*b* are preferably set at a divergent angle of 25 degrees to each other to facilitate keeping the net 112 open prior to capturing the maritime object. The rockets 114*a* and 114*b* are connected to the net 112 by a harness 116. In one embodiment the net 112 is also kept opened by drag-chutes 118*a* and 118*b* connected to the trailing edge of the net 112. In another embodiment, a breakaway line is attached to the deceleration devices 18*a* and 18*b* instead of using drag-chutes 118*a* and 118*b*. The net 112 connects to deceleration devices 16*a*, 18*a* and 20*a* on one side of the net 112 and to deceleration devices 16*b*, 18*b* and 20*b* on the other side of the net 112.

Figure 7:
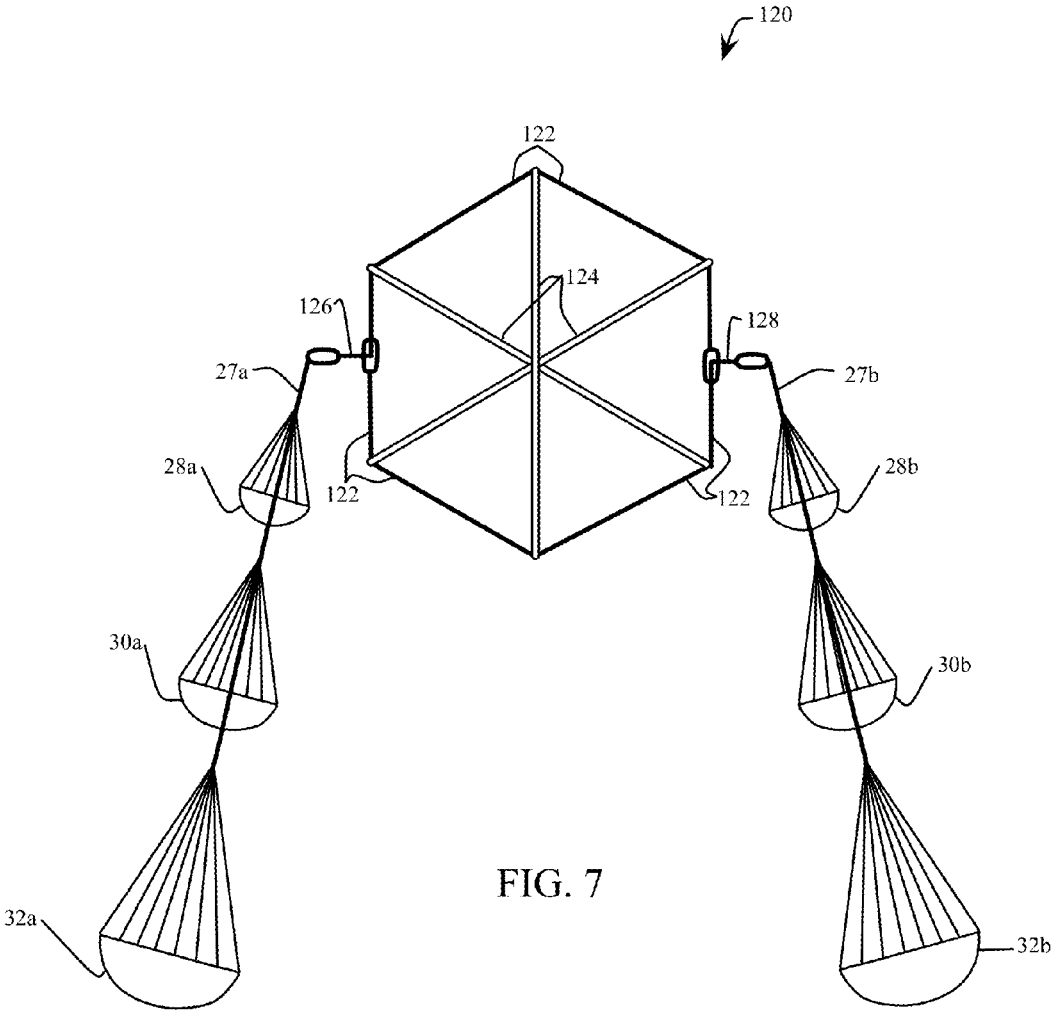
FIG. 7 is a plan view of an embodiment of a tensegrity-expanded engagement net as shown in FIG. 1B.

FIG. 7 illustrates an example of a NEPS system 120 using a tensegrity structure as used in the embodiment shown in FIG. 1B. In one example, load-bearing lines 122 are formed by cables under tension that surround the outside of the tensegrity structure. For a hexagon tensegrity structure the cables would connect the end points of every other rod 124. The embodiment 120 is shown using the lasso structure of FIG. 5 with a top load bearing line 126 connected to a rode line 27*a* and a bottom load bearing line 128 connected to a rode line 27*b*. The rode line 27*a* connects to three PSAs, 28*a*, 30*a* and 32*a* respectively. In contrast to the embodiment 110 in FIG. 6, the NEPS system 120 using the tensegrity structure relies on a guided parafoil, rather than rockets, to propel the NEPS system 120 towards the bow of a ship. As illustrated in FIG. 1A and FIG. 1B, the tensegrity structure remains compact while attached to the parafoil to reduce the aerodynamic drag. After the tensegrity structure lands on the bow of the target vessel, the PSAs are deployed. When the PSAs create a drag force under water, the resulting force on the rode lines 27*a* and 27*b* breaks the tensegrity structure and causes the load bearing lines 122 to cinch around the bow of the vessel.

The dynamic load equalization of the engagement nets afforded by the use of movable self-tensioning loops shown in FIG. 4A and a lasso shown in FIG. 5, significantly reduce the NEPS system volume and weight. Synergistically, the staged release of progressively larger PSAs, permits the use of smaller and lighter weight PSAs, which when used with the smaller and lighter weight engagement nets enables the efficient placement of the engagement net on the bow of a ship or other maritime objects.

Figure 8:
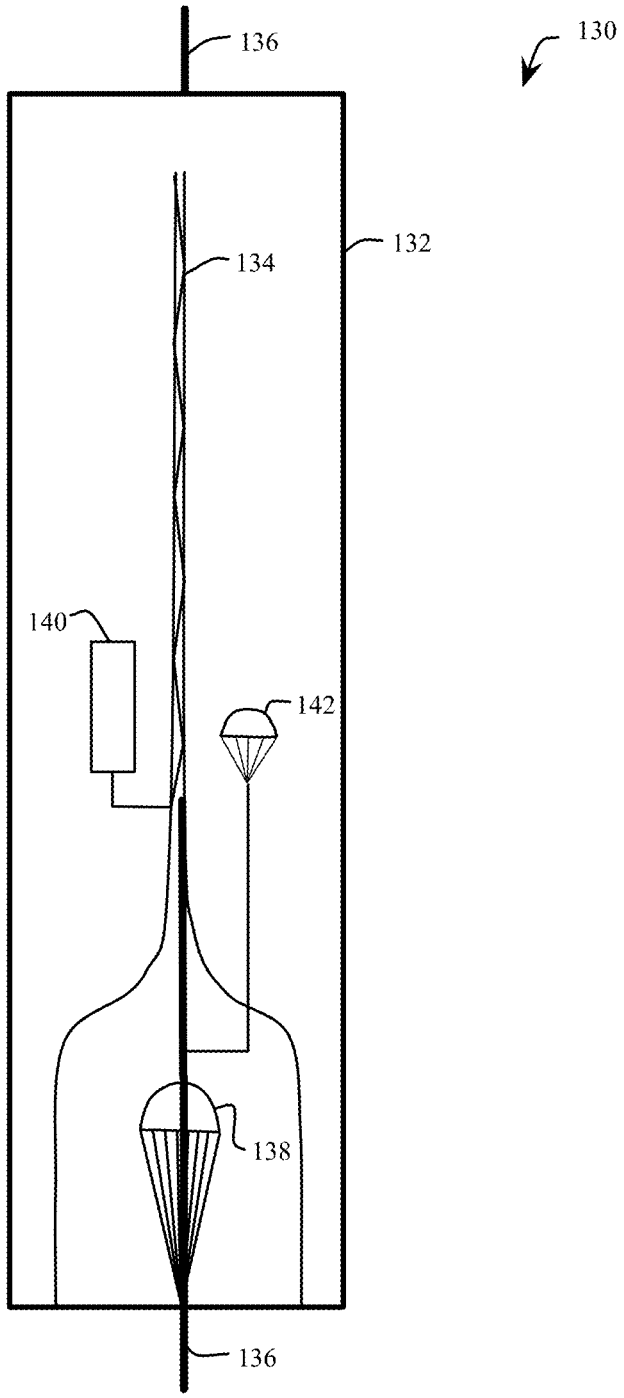
FIG. 8 is a schematic view of a deceleration device.

In a preferred embodiment, the deceleration devices 16*a-b*, 18*a-b* and 20*a-b* include mechanisms for the timed release of PSAs in an aerodynamically efficient enclosure as further detailed in FIG. 8. The deceleration device 130 is enclosed in a deployment bag 132 held closed by a webbing 134. The deployment bag 132 connects to either the engagement net or another deployment bag with a rode line 136 that also connects to a PSA 138. A programmable time release unit (PTRU) 140 releases the webbing 134 at a time predetermined based on the anticipated loading on the PSA 138 by the maritime object that the NEPS system is designed to decelerate. In one embodiment, the PTRU 140 timer is activated and starts the time interval when the pressure on the rode line 136 exceeds a threshold. After the webbing 134 is released by the PTRU 140, an exposed drag-chute 142 will pull the PSA 138 out of the deployment bag 132 and allowing the PSA 138 to inflate.

In one embodiment, the PTRU 140 includes an electronic time clock that activates a piston actuator that releases a clamp after a preset time interval. The clamp then releases the webbing 134 allowing the deployment bag 132 to open. The piston actuator optionally includes mechanical leverage to allow the clamp to open when the webbing is under tension. For example, mechanical leverage is used to drive a clamp loaded with several thousand pounds of force imposed by the webbing 134 with a piston actuator only capable for providing five pounds of force. In another embodiment, the PTRU 140 uses a dissolvable salt tablet, instead of an electronic time clock, to determine when the piston actuator should be activated.

Figure 9:
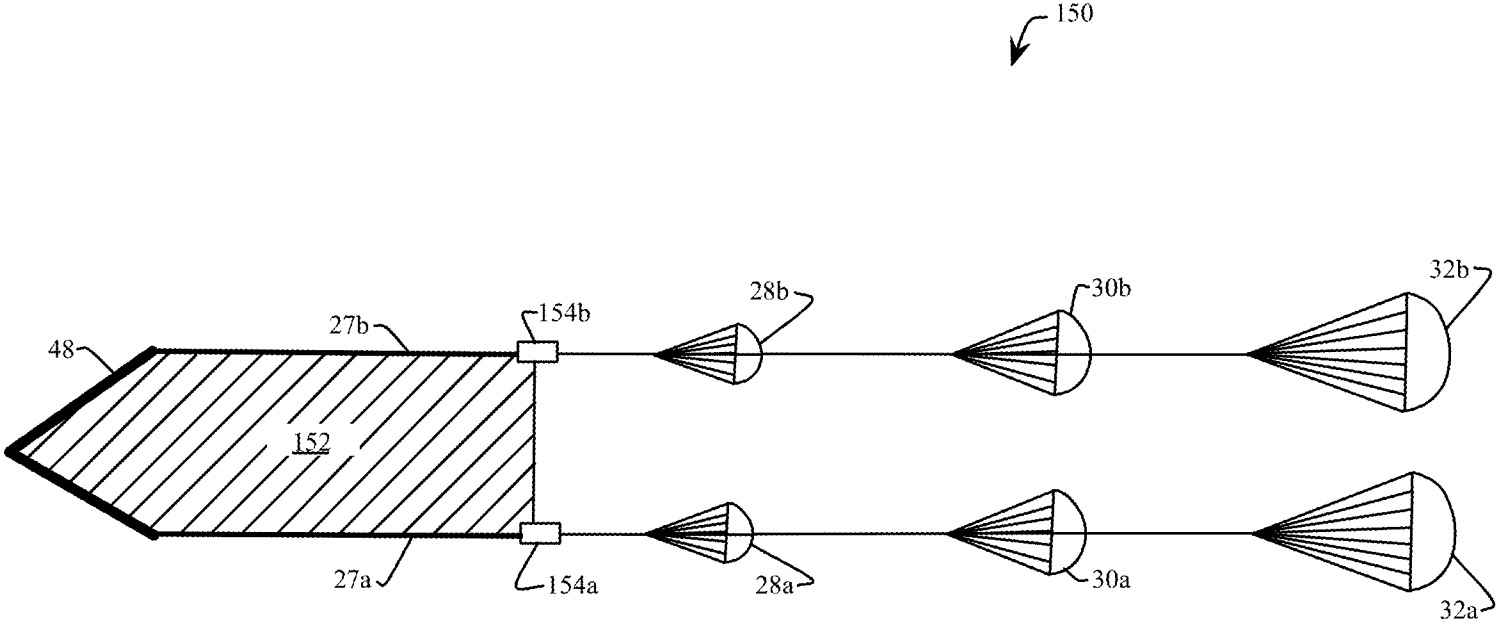
FIG. 9 is a schematic view of test setup of the NEPS system.

The performance of the NEPS systems shown in various embodiments of FIG. 1A through FIG. 3C was tested under various conditions and test setups, an example of which is shown in FIG. 9. The test setup 150 used a scaled model of a ship 152 to verify the performance of the PSAs and to extrapolate the performance of the NEPS system 42 shown in FIG. 2C and FIG. 3C. The PSAs 28*a*, 30*a* and 32*a* are connected to a load cell 154*a* used to monitor the total drag force provided by the PSAs 28*b*, 30*b* and 32*b*. The PSAs 28*b*, 30*b* and 32*b* are connected to a load cell 154*b* used to monitor the total drag force provided by the PSAs 28*b*, 30*b* and 32*b*. The load cell 154*a* is connected to the engagement net 48 with a rode line 27*a*. The load cell 154*b* is connected to the engagement net 48 with a rode line 27*b*.

Figure 10A:
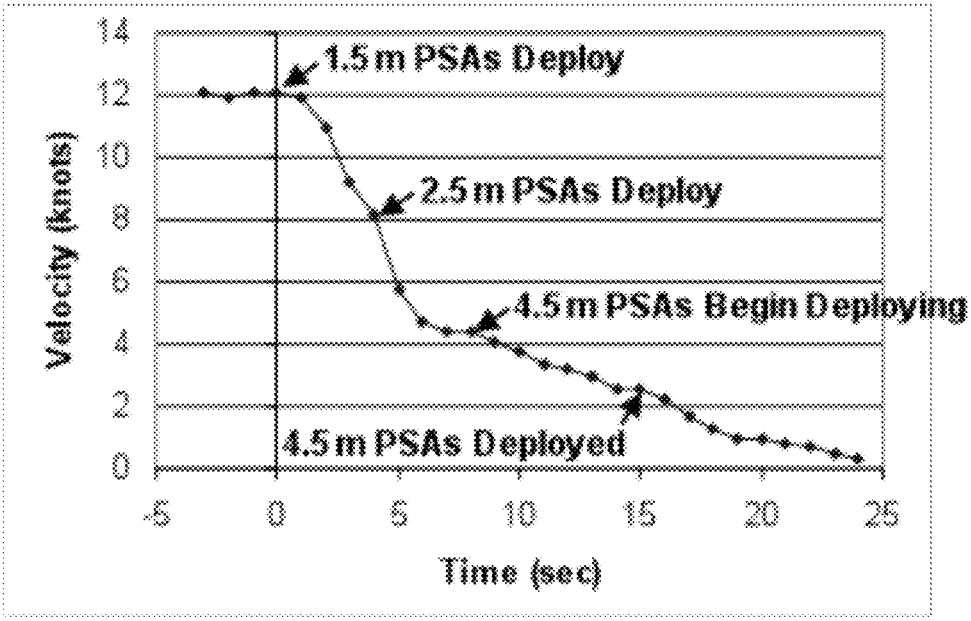
FIG. 10A is a graphical view illustrating the rate of deceleration of the vessel shown in FIG. 9.
Figure 10B:
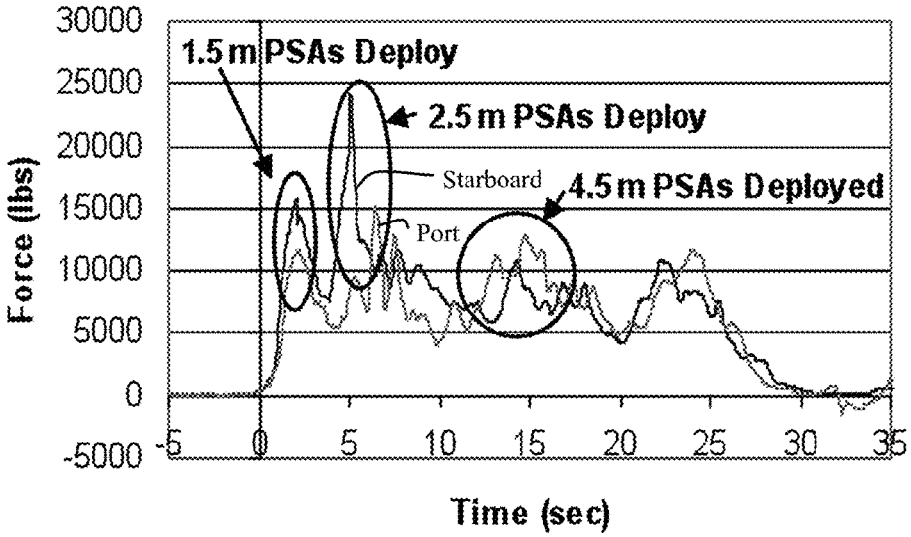
FIG. 10B is a graphical view illustrating the distribution of force over time for the parachute sea anchors shown in FIG. 9.

FIG. 10A and FIG. 10B further illustrate the performance of the test setup 150 shown in FIG. 9. A ship 152 with 99 tons of displacement, measuring 24 meters in length, with a beam of 6 meters and maximum velocity of 13 knots was tested and the results showed that the ship 152 was stopped within 30 seconds. FIG. 10A shows the deceleration of the ship 152 from an initial forward velocity of 12 kts with staged deployment of PSAs to maximize the deceleration of the ship 152 without exceeding the design load limits for each PSA.

The first set of PSAs to deploy are PSA 28*a* and PSA 28*b*, each having a 1.5 meter diameter and deployed approximately 2 seconds after the engagement net 48 contacts the bow of the ship 152. The second set of PSAs to deploy are PSA 30*a* and PSA 30*b*, each having a 2.5 meter diameter and deployed approximately 5-7 seconds after the engagement net 48 contacts the bow of the ship 152. The speed of the ship 152 has decreased to 8 knots by the time the second set of PSAs are deployed. The third set of PSAs to deploy are PSA 32*a* and PSA 32*b*, each having a 4.5 meter diameter and deployed approximately 15 seconds after the engagement net 48 contacts the bow of the ship 152. The speed of the ship 152 has decreased to 4 knots by the time the third set of PSAs are deployed. The test results shown in FIG. 10A and FIG. 10B show a rapid and smooth rate of deceleration of the ship 152 with a relatively uniform load (e.g. force) on the NEPS system.

Figure 11:
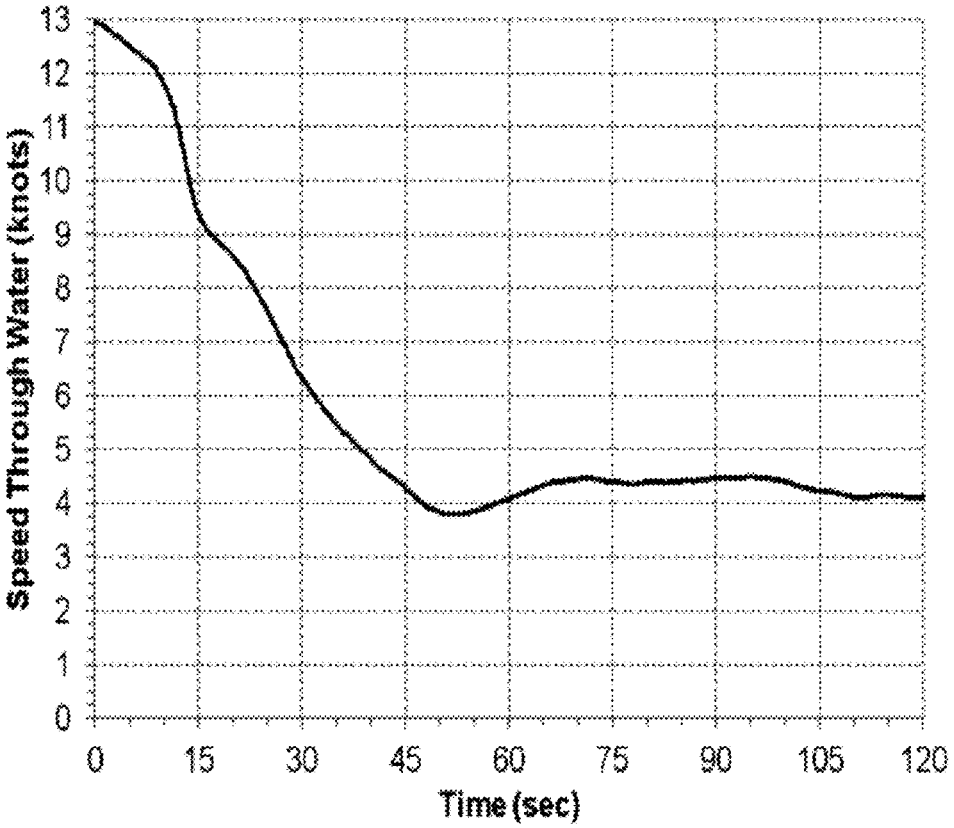
FIG. 11 is a graphical view illustrating the rate of deceleration of a full-scale vessel.

Subsequent to testing a scaled model as shown in FIG. 9, FIG. 10A and FIG. 10B, a full-scale vessel was tested with deceleration results shown in FIG. 11. The full-scale vessel had 3,568 tons of displacement, measured 75 meters in length, with a beam of 18 meters and a maximum velocity of 15 knots. The NEPS system used for the full-scale vessel used three PSAs with canopy diameters of 4.5 meters, 7.5 meters and 12 meters respectively. FIG. 11 shows the successful deceleration of the full-scale vessel from 13 knots down to 4 knots within 60 seconds, consistent with estimates extrapolated from scaled model tests shown in FIG. 9, FIG. 10A and FIG. 10B, thereby demonstrating the maturity of this technology.

While the invention has been shown and described with reference to specific preferred embodiments, it should be understood by those skilled in the art that various changes in form and detail may be made therein without departing from the spirit and scope of the invention as defined by the following claims.

What is claimed is:

1. A momentum altering system comprising:

a transportation device configured to transport the momentum altering system from an aircraft towards an object moving through water, wherein the transportation device includes a parafoil;

an engagement device configured to attach to the object when the momentum altering system is transported sufficiently near the object, wherein the engagement device comprises a load bearing line in communication with one or more self-tensioning loops, the one or more self-tensioning loops in communication with a base net based on a tensegrity structure with a lasso, the self-tensioning loops distorting the base net to increase a contact area between the base net and the object upon contact of a portion of the base net with the object; and at least one decelerating device connected to the engagement device, the at least one decelerating device deployed by the engagement device after the engagement device attaches to the object, wherein deploying the at least one decelerating device includes deploying a plurality of parachute sea anchors (PSAs) at a preset time by a programmable time release unit (PTRU) that includes an electronic timer, each of the plurality of PSAs being deployed with temporal separation from another of the plurality of PSAs sufficient to alter the momentum of the object within a load limit of each of the plurality of PSAs, wherein each of the plurality of PSAs produces drag against a progressively larger volume of water than a previously deployed PSA of the same deceleration device.

2. The momentum altering system of claim 1 further comprising a controller to steer the parafoil towards the object.

3. A momentum altering method comprising:

transporting a net towards an object moving through water, the net having a lasso-based structure connected to a plurality of parachute sea anchors (PSAs) by a plurality of self-tensioning loops;

engaging the object with the net;

deploying each of the plurality of PSAs into the water with temporal separation from another of the plurality of PSAs, each of the plurality of PSAs resisting a larger volume of water than a previously deployed PSA, and the net tightening to substantially conform to a feature of the object by causing at least one of the plurality of self-tensioning loops to move thereby distributing a load of the plurality of PSAs to the net; and decelerating the object by resisting a flow of water.

4. The momentum altering method of claim 3 further comprising launching the parafoil from an aircraft.

5. The momentum altering method of claim 3 further comprising launching at least one rocket from a helicopter and wherein the at least one rocket transports the net towards the object.

6. The momentum altering method of claim 3 further comprising launching at least one rocket from a ship and wherein the at least one rocket transports the net towards the object.

* * * * *